US010495342B2

(12) United States Patent
Suzuki et al.

(10) Patent No.: US 10,495,342 B2
(45) Date of Patent: Dec. 3, 2019

(54) INDOOR UNIT OF AIR-CONDITIONING APPARATUS

(71) Applicant: Mitsubishi Electric Corporation, Tokyo (JP)

(72) Inventors: Akimoto Suzuki, Tokyo (JP); Masato Ishikawa, Tokyo (JP); Masahide Kinami, Tokyo (JP); Hisanori Ikeda, Tokyo (JP); Youhei Koyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 67 days.

(21) Appl. No.: 15/765,122

(22) PCT Filed: Dec. 1, 2015

(86) PCT No.: PCT/JP2015/083752
§ 371 (c)(1),
(2) Date: Mar. 30, 2018

(87) PCT Pub. No.: WO2017/094115
PCT Pub. Date: Jun. 8, 2017

(65) Prior Publication Data
US 2018/0283730 A1 Oct. 4, 2018

(51) Int. Cl.

| | |
|---|---|
| ***F24F 5/00*** | (2006.01) |
| ***F24F 13/20*** | (2006.01) |
| ***F24F 1/0057*** | (2019.01) |
| ***F24F 1/0025*** | (2019.01) |

(52) U.S. Cl.
CPC ..... *F24F 13/20* (2013.01); *F24F 1/0025* (2013.01); *F24F 1/0057* (2019.02); *F24F 2221/26* (2013.01)

(58) Field of Classification Search
CPC ..... F24F 13/20; F24F 1/0057; F24F 1/0025; F24F 2221/26
USPC ..... 454/233
See application file for complete search history.

(56) References Cited

FOREIGN PATENT DOCUMENTS

| | | | |
|---|---|---|---|
| JP | 2007-225253 | A | 9/2007 |
| JP | 2009-079869 | A | 4/2009 |
| JP | 5061812 | B2 | 10/2012 |

OTHER PUBLICATIONS

International Search Report dated Feb. 23, 2016 issued in corresponding international patent application No. PCT/JP2015/083752.

*Primary Examiner* — Helena Kosanovic
(74) *Attorney, Agent, or Firm* — Posz Law Group, PLC

(57) ABSTRACT

Provided is an indoor unit of an air-conditioning apparatus including a rectangular front panel provided on a front surface side of an indoor unit body. The rectangular front panel is constructed such that a design panel is mounted to a front surface side of a base panel, that a flange of the design panel is received in a groove portion of the base panel, and that first fitting portions of the base panel and second fitting portions of the design panel are fitted to each other.

5 Claims, 11 Drawing Sheets

A—A

B—B

C—C

X–X

X–X

X–X

X–X

INDOOR UNIT OF AIR-CONDITIONING APPARATUS

CROSS REFERENCE TO RELATED APPLICATION

This application is a U.S. national stage application of PCT/JP2015/083752 filed on Dec. 1, 2015, the contents of which are incorporated herein by reference.

TECHNICAL FIELD

The present invention relates to an indoor unit of an air-conditioning apparatus including a front panel with improved design property.

BACKGROUND ART

In a related-art indoor unit of an air-conditioning apparatus, there is given one in which a design panel constructing a front surface side of a front panel is formed of a transparent member, and a coating is applied on a back surface side of the front panel so that the design of the coated surface is transmitted through the transparent member to appear on an outer appearance of the front of the indoor unit, thereby enhancing design property of the indoor unit (see, for example, Patent Literature 1).

In Patent Literature 1, a base panel formed of an opaque member and provided, on its back surface side, with hinges to rotatably mount the front panel onto a front surface of an indoor unit body is mounted to the design panel to construct the back surface side of the front panel.

Further, the design panel has fixing holes formed in both end portions in a vertical direction, and the base panel has claw portions formed on both the end portions in the vertical direction. Each of the claw portions of the base panel is inserted into a corresponding one of the fixing holes of the design panel. In this manner, the base panel is mounted on a back surface side of the design panel.

CITATION LIST

Patent Literature

Patent Literature 1: Japanese Patent No. 5061812

SUMMARY OF INVENTION

Technical Problem

In Patent Literature 1, there has been a problem of degrading the design property of the front panel when the front panel is opened from the indoor unit body. This is because the fixing holes of the design panel are visually recognized from outside and the claw portions of the base panel are seen through the fixing holes.

Further, there has been a problem in that, even when the fixing holes of the design panel are formed into a recessed shape not to be visually recognized, the claw portions of the base panel are seen through portions each having a recessed shape because the design panel is formed of the transparent member.

The present invention has been made to solve the above-mentioned problems, and has an object to provide an indoor unit of an air-conditioning apparatus including a front panel that is improved in design property and has a front surface constructed by a design panel formed of a transparent member.

Solution to Problem

According to one embodiment of the present invention, there is provided an indoor unit of an air-conditioning apparatus including a front panel provided on a front surface side of an indoor unit body, the front panel including a base panel formed of an opaque member, and a design panel formed of a transparent member, and having a design layer on a back surface of the design panel. The base panel has a front surface including a first side wall portion formed at an end portion of the base panel in a vertical direction, and extending along a horizontal direction, a second side wall portion formed on a more inner side than the first side wall portion, and extending along the horizontal direction, a groove portion formed between the first side wall portion and the second side wall portion, and having a recessed shape continuous along the horizontal direction, and a plurality of first fitting portions provided at intervals on an inner surface side of the first side wall portion, and aligned along the horizontal direction. The design panel has the back surface including a flange formed on a more inner side than an end portion of the design panel in the vertical direction, and protruding along the horizontal direction, and a plurality of second fitting portions provided at intervals on an outer surface side of the flange, and aligned along the horizontal direction. Each of the plurality of first fitting portions includes a claw portion having a protruding shape, and each of the plurality of second fitting portions includes a recess having a recessed shape, or each of the plurality of first fitting portions includes a recess having a recessed shape, and each of the plurality of second fitting portions includes a claw portion having a protruding shape. In the front panel, the design panel is mounted to a front surface side of the base panel, the flange of the design panel is received in the groove portion of the base panel, and the plurality of first fitting portions of the base panel and the plurality of second fitting portions of the design panel are fitted to each other.

Advantageous Effects of Invention

In the indoor unit of an air-conditioning apparatus of one embodiment of the present invention, in the front panel, the flange of the design panel is received in the groove portion of the base panel, and the first fitting portions of the base panel and the second fitting portions of the design panel are fitted to each other. In this manner, the design panel is mounted to the front surface side of the base panel to cover the base panel. In this case, at the side portion of the front panel in the vertical direction, the first fitting portions are formed on the inner surface side of the first side wall portion of the opaque base panel. Further, the second fitting portions of the design panel that is transparent but has the design layer formed on its back surface side are positioned on the inner side of the first side wall portion of the opaque base panel. Thus, the first fitting portions of the base panel and the second fitting portions of the design panel are not visually recognized from outside, and hence it is possible to improve the design property of the front panel having the front surface constructed by the design panel formed of the transparent member.

DESCRIPTION OF EMBODIMENTS

Figure 1:
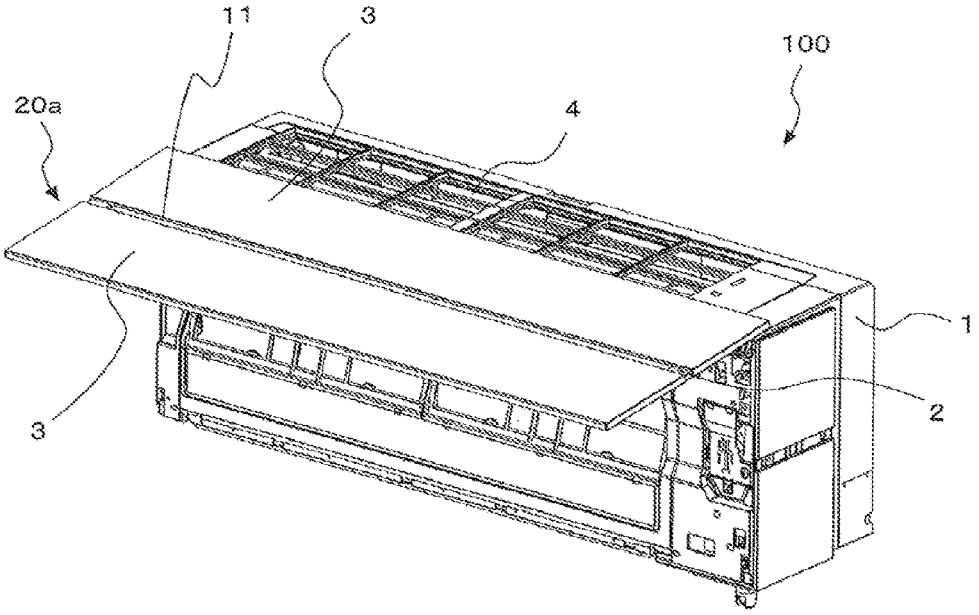
FIG. 1 is an external perspective view of an indoor unit of an air-conditioning apparatus according to Embodiment 1 of the present invention when the indoor unit is seen from a front side of the indoor unit.

Embodiment 1 of the present invention is described below with reference to the drawings. The present invention is not limited to embodiments described below. Further, in the drawings referred to below, the size relationship between components may be different from the reality in some cases.

Embodiment 1

Figure 2:
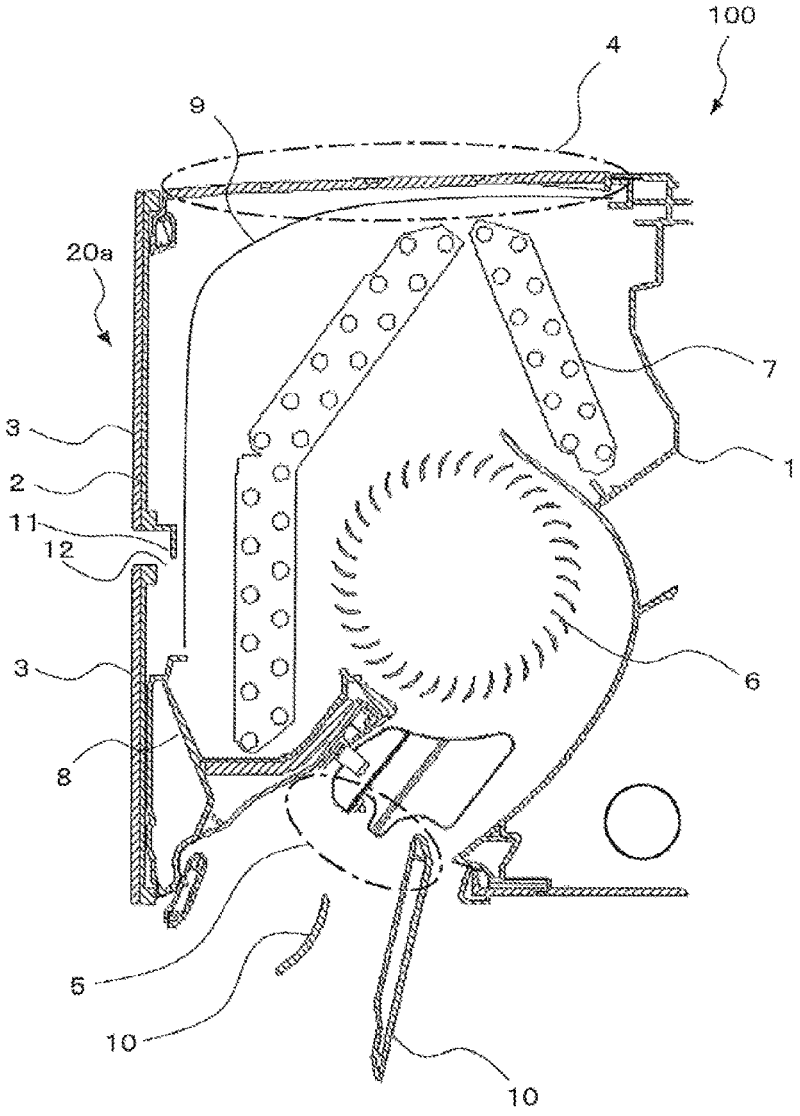
FIG. 2 is a vertical sectional view of the indoor unit of the air-conditioning apparatus according to Embodiment 1 of the present invention.

FIG. 1 is an external perspective view of an indoor unit of an air-conditioning apparatus according to Embodiment 1 of the present invention when the indoor unit is seen from a front side of the indoor unit. FIG. 2 is a vertical sectional view of the indoor unit of the air-conditioning apparatus according to Embodiment 1 of the present invention.

In FIG. 1, there is illustrated a state in which a front panel 20*a* is opened from an indoor unit body 100. In FIG. 2, a part on the left side of FIG. 2 is illustrated as a front surface side of the indoor unit.

In the following description, for ease of understanding, directional terms (such as "upper", "lower", "right", and "left") are used as appropriate. The terms are used for the purpose of description, but do not limit the invention of the subject application. Further, in Embodiment 1, the terms "upper", "lower", "right", and "left" are used under a state in which the indoor unit is seen from the front side of indoor unit unless otherwise noted.

With reference to FIG. 1 to FIG. 2, a configuration of the indoor unit is described below.

The indoor unit according to Embodiment 1 supplies conditioned air into an air-conditioned space such as an inside of a room using a refrigeration cycle configured to circulate refrigerant. In Embodiment 1, there is exemplified a case where the indoor unit is a wall-mounted type to be mounted to a wall surface of the air-conditioned space.

The indoor unit body 100 includes a front panel 20*a*, an upper air inlet 4, and an air outlet 5. The front panel 20*a* includes a back case 1 arranged on a back surface side of the indoor unit body 100 and mounted to a wall surface, a base panel 2 arranged on a front surface side of the indoor unit body 100, and having a central recess 11 and a front air inlet 12 formed in the base panel 2, and design panels 3 mounted to a front surface side of the base panel 2. The upper air inlet 4 is formed in an upper portion of the indoor unit body 100, and is configured to mainly suck indoor air into the indoor unit body 100. The air outlet 5 is formed in a lower portion of the indoor unit body 100, and is configured to supply the conditioned air into the air-conditioned space.

An air-sending fan 6 and a heat exchanger 7 are accommodated in the indoor unit body 100. The air-sending fan 6 sucks the indoor air through the upper air inlet 4 and the front air inlet 12, and blows out the conditioned air through the air outlet 5. The heat exchanger 7 is arranged to cover the air-sending fan 6 from above, and is configured to exchange heat between the refrigerant and the indoor air, to thereby generate the conditioned air. These components define an airflow path in the indoor unit body 100. Further, an electric component box (not shown) and a drain pan 8 are arranged in the indoor unit body 100. A circuit board and other components are accommodated in the electric component box. The drain pan 8 is arranged below a lower end portion of the heat exchanger 7, and is configured to collect water condensed on the heat exchanger 7.

The air-sending fan 6 is, for example, a cross flow fan, and the heat exchanger 7 is, for example, a fin-tube-type heat exchanger. However, the air-sending fan 6 and the heat exchanger 7 are not limited to these examples.

Further, a filter 9 configured to remove dust and other matters contained in the sucked indoor air is arranged between the upper air inlet 4 and the heat exchanger 7 and between the front air inlet 12 and the heat exchanger 7. In addition, an up-and-down airflow direction adjusting flap 10 configured to control a direction of a flow of blown-out air is arranged in the air outlet 5.

Next, a flow of the air in the indoor unit body 100 is briefly described.

First, the air-sending fan 6 causes the indoor air to flow through the upper air inlet 4 and the front air inlet 12 of the indoor unit body 100 into the indoor unit body 100. In this case, dust and other matters contained in the air are removed by the filter 9. While the indoor air is passing through the heat exchanger 7, the indoor air is heated or cooled by the refrigerant circulating in the heat exchanger 7, and is changed into the conditioned air. Then, after a direction of a flow of the conditioned air is adjusted by the up-and-down airflow direction adjusting flap 10, the conditioned air is blown out through the air outlet 5 to an outside of the indoor unit body 100, that is, to the air-conditioned space.

Figure 3:
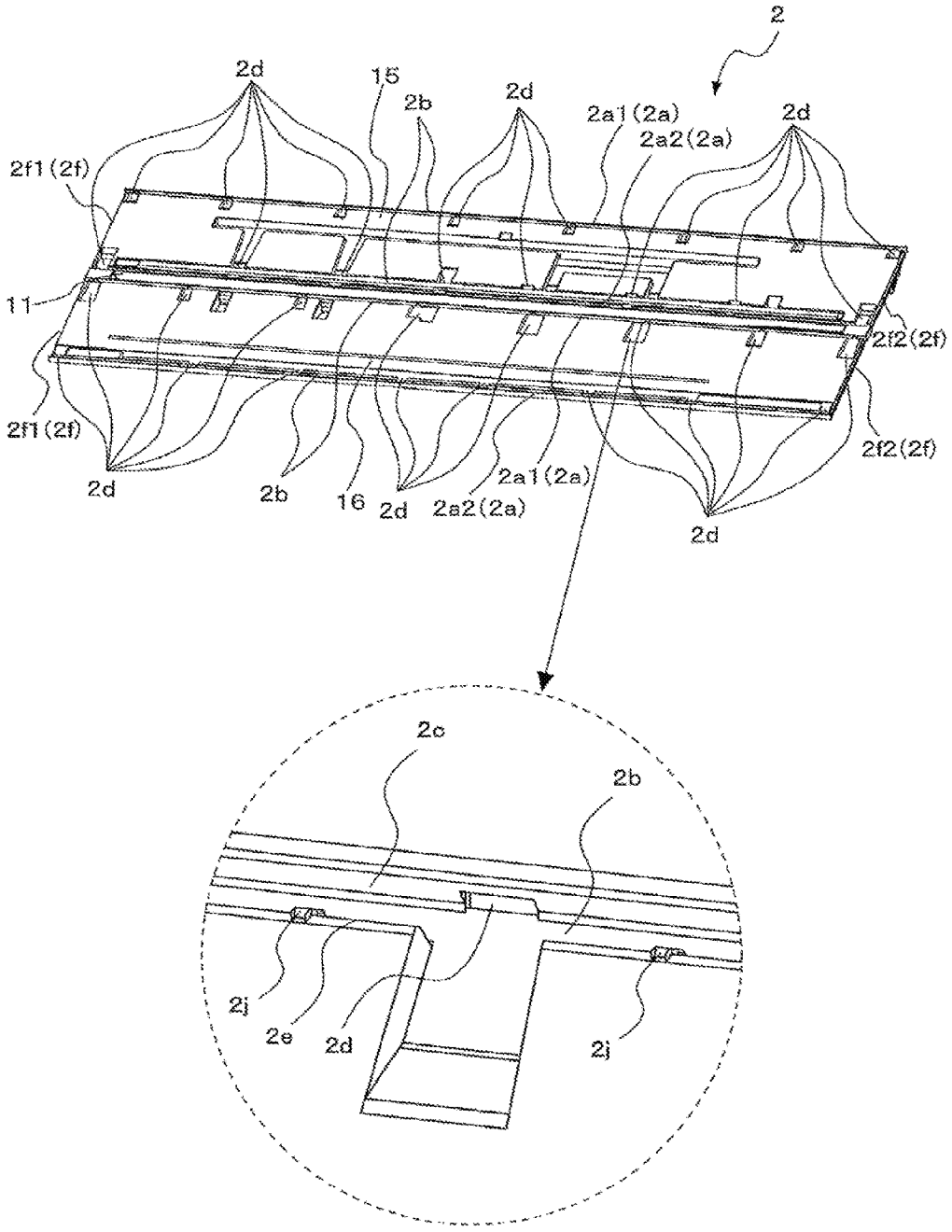
FIG. 3 are a perspective view of a front surface of a base panel of the indoor unit of the air-conditioning apparatus according to Embodiment 1 of the present invention and an enlarged perspective view of a part of the front surface.
Figure 4:
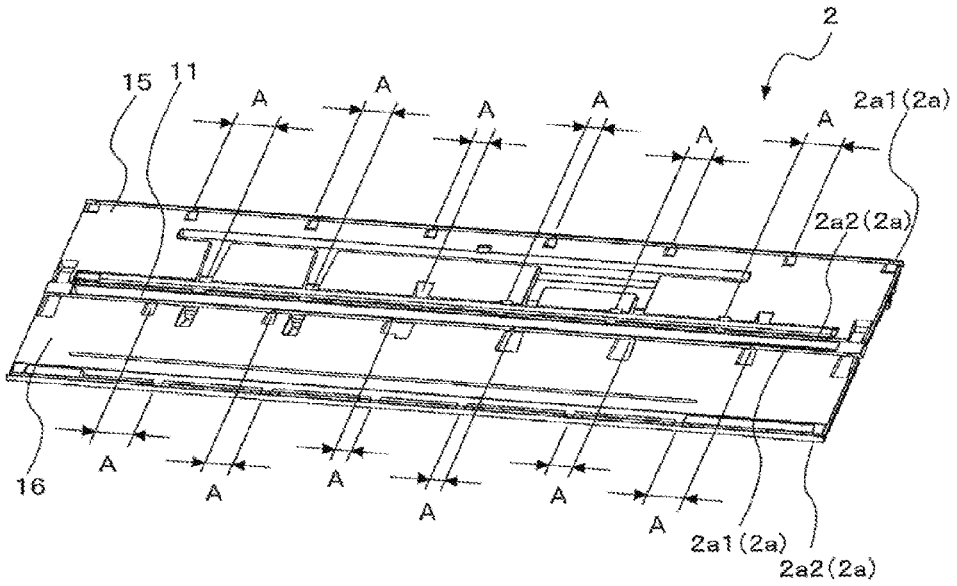
FIG. 4 is a perspective view for illustrating the front surface of the base panel of the indoor unit of the air-conditioning apparatus according to Embodiment 1 of the present invention.
Figure 5:
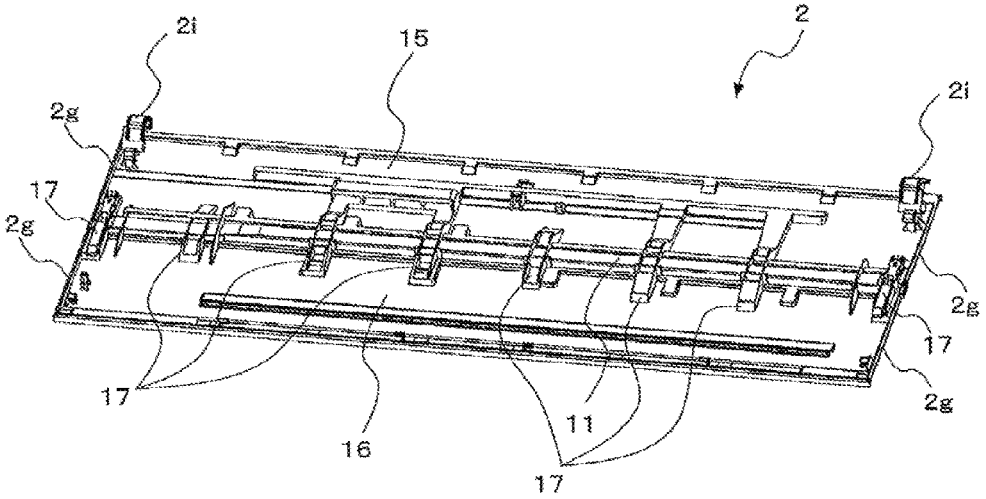
FIG. 5 is a perspective view for illustrating a back surface of the base panel of the indoor unit of the air-conditioning apparatus according to Embodiment 1 of the present invention.

FIG. 3 are a perspective view of a front surface of the base panel 2 of the indoor unit of the air-conditioning apparatus according to Embodiment 1 of the present invention and an enlarged perspective view of a part of the front surface. FIG. 4 is a perspective view for illustrating the front surface of the base panel 2 of the indoor unit of the air-conditioning apparatus according to Embodiment 1 of the present invention. FIG. 5 is a perspective view of a back surface of the base panel 2 of the indoor unit of the air-conditioning apparatus according to Embodiment 1 of the present invention.

In FIG. 4, a positional relationship of recesses 2*d* is illustrated by drawing lines from positions of the recesses 2*d*, and the illustration of the recesses 2*d* is omitted.

The base panel 2 is formed of an opaque member, for example, an opaque resin, and hence the back surface side is not seen through the front surface side. Further, as illustrated in FIG. 3, the front surface of base panel 2 has a flat surface shape except for some regions. Further, the base panel 2 has a rectangular shape. Under a state in which the indoor unit body 100 is mounted to the wall surface, in front view, a longitudinal direction of the base panel 2 corresponds to a lateral direction, that is, a horizontal direction, whereas a transverse direction of the base panel 2 corresponds to an up-and-down direction, that is, a vertical direction. Further, the base panel 2 includes a base panel upper portion 15, a base panel lower portion 16, a central recess 11, and connection portions 17.

The central recess 11 is formed at a center of the base panel 2 in the up-and-down direction in front view to extend from an inner side of a left end portion 2*f*1 to an inner side of a right end portion 2*f*2. Thus, the center of the base panel 2 in the up-and-down direction is recessed from the front surface side toward the back surface side. Further, the central recess 11 is recessed from the front surface side toward the back surface side, and the front air inlet 12 (see FIG. 2) is formed at a lower part of the central recess 11. The formed position of the central recess 11 need not be strictly center in the up-and-down direction.

Further, in the base panel 2, the rectangular base panel upper portion 15 is provided above the central recess 11 in front view, and the rectangular base panel lower portion 16 is provided below the central recess 11 in front view. Further, on the back surface of the base panel 2, the plurality of connection portions 17 are provided along the longitudinal direction. The base panel upper portion 15 and the base panel lower portion 16 are connected to each other by the connection portions 17.

As illustrated in FIG. 3, in each of the front surface of the base panel upper portion 15 and the front surface of the base panel lower portion 16, a first side wall portion 2*c* is formed at each end portion 2*a* in the transverse direction to extend from the left end portion 2*f*1 to the right end portion 2*f*2 along the longitudinal direction. Further, on an inner surface side of the first side wall portion 2*c*, the plurality of recesses 2*d* each having a recessed shape are formed at intervals along the longitudinal direction. Further, on a more inner side than the first side wall portion 2*c*, a second side wall portion 2*e* is formed to extend from the left end portion 2*f*1 to the right end portion 2*f*2 along the longitudinal direction. The first side wall portion 2*c* and the second side wall portion 2*e* face each other. On an outer surface side of the second side wall portion 2*e*, a plurality of ribs 2*j* each having a protruding shape are provided at intervals, and aligned along the longitudinal direction. The ribs 2*j* are provided at positions shifted from claw portions 3*c* in the longitudinal direction.

Further, a groove portion 2*b* is formed between the first side wall portion 2*c* and the second side wall portion 2*e* to extend from the left end portion 2*f*1 to the right end portion 2*f*2 along the longitudinal direction.

The groove portion 2*b* has a recessed shape continuous along the longitudinal direction, and the first side wall portion 2*c* and the second side wall portion 2*e* protrude from the groove portion 2*b* toward the front surface side.

Further, as illustrated in FIG. 4, the formed positions of the recesses 2*d* in an upper end portion 2*a*1 and the formed positions of the recesses 2*d* in a lower end portion 2*a*2 of the base panel upper portion 15 in the transverse direction are shifted by a length A in the longitudinal direction, and the formed positions of the recesses 2*d* in an upper end portion 2*a*1 and the formed positions of the recesses 2*d* in a lower end portion 2*a*2 of the base panel lower portion 16 in the transverse direction are shifted by the length A in the longitudinal direction. This is for the purpose of, when the design panels 3 are mounted to the base panel upper portion 15 and the base panel lower portion 16, preventing the design panels 3 from being mounted upside down. When the design panel 3 does not need to be prevented from being mounted upside down, the formed positions of the recesses 2*d* in the upper end portion 2*a*1 and the formed positions of the recesses 2*d* the lower end portion 2*a*2 of the base panel upper portion 15 in the transverse direction need not be shifted in the longitudinal direction, and the formed positions of the recesses 2*d* in the upper end portion 2*a*1 and the formed positions of the recesses 2*d* the lower end portion 2*a*2 of the base panel lower portion 16 in the transverse direction need not be shifted in the longitudinal direction.

Further, as illustrated in FIG. 5, on each of a right and left sides on the back surface of the base panel upper portion 15, a hinge 2*i* is provided for mounting the front panel 20*a* to a front surface of the indoor unit body 100. The hinges 2*i* are inserted into hinge holes (not shown) formed in the front surface of the indoor unit body 100 so that the front panel 20*a* is openably and closably mounted to the front surface of the indoor unit body 100. The number of hinges 2*i* is not limited to two. Further, a flange 2*g* is formed on respective end portions 2*f* of each of the back surface of the base panel upper portion 15 and the back surface of the base panel lower portion 16 in the longitudinal direction, and the flanges 2*g* each protrudes toward the back surface side.

Figure 6:
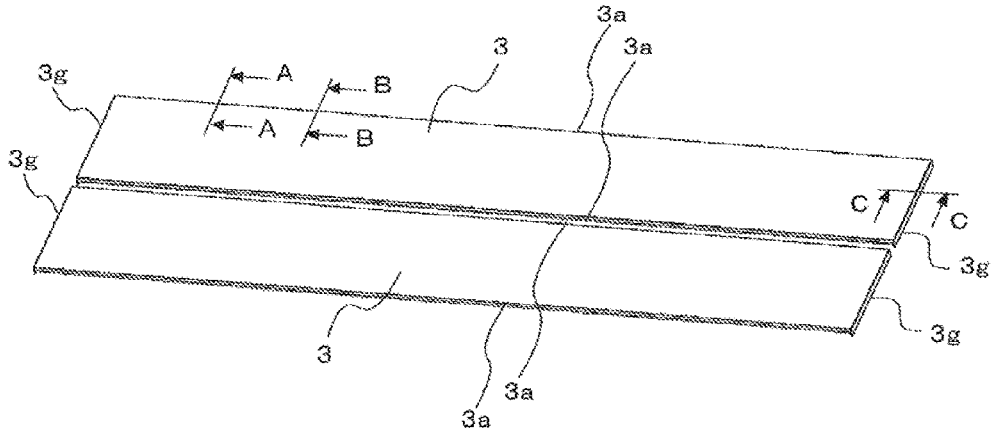
FIG. 6 is a perspective view for illustrating front surfaces of design panels of the indoor unit of the air-conditioning apparatus according to Embodiment 1 of the present invention.
Figure 7:
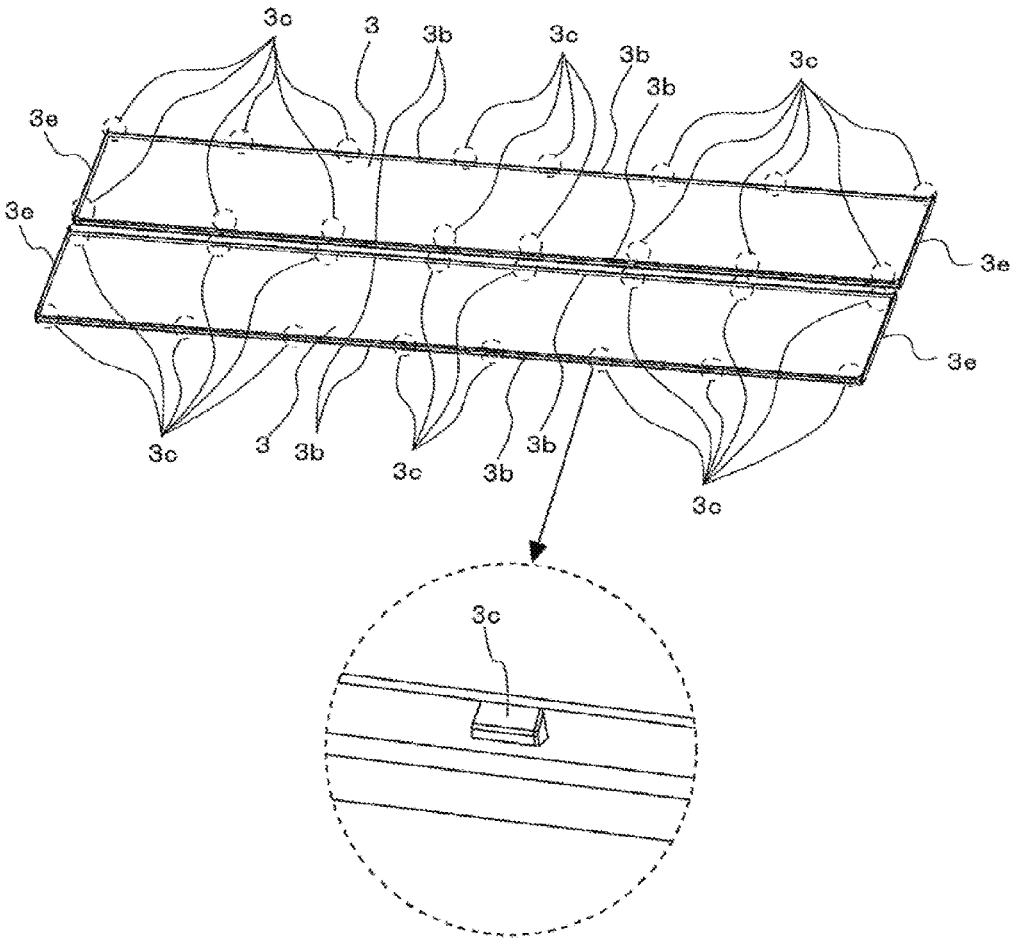
FIG. 7 are a perspective view of back surfaces of the design panels of the indoor unit of the air-conditioning apparatus according to Embodiment 1 of the present invention and an enlarged perspective view of a part of the back surfaces.
Figure 8:
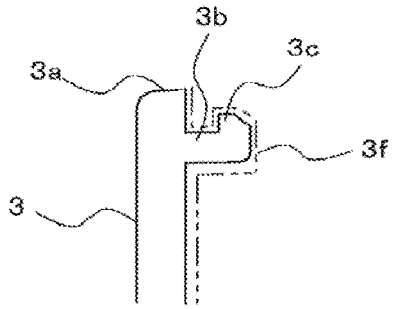
FIG. 8 is a sectional view taken along the line A-A of FIG. 6.
Figure 9:
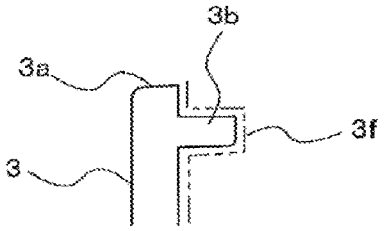
FIG. 9 is a sectional view taken along the line B-B of FIG. 6.
Figure 10:
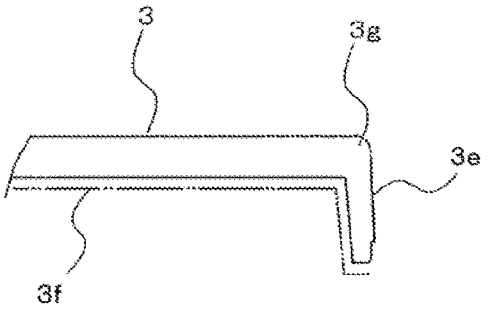
FIG. 10 is a sectional view taken along the line C-C of FIG. 6.

FIG. 6 is a perspective view for illustrating front surfaces of the design panels 3 of the indoor unit of the air-conditioning apparatus according to Embodiment 1 of the present invention. FIG. 7 are a perspective view for illustrating back surfaces of the design panels 3 of the indoor unit of the air-conditioning apparatus according to Embodiment 1 of the present invention and an enlarged perspective view of a part of the back surfaces. FIG. 8 is a sectional view taken along the line A-A of FIG. 6. FIG. 9 is a sectional view taken along the line B-B of FIG. 6. FIG. 10 is a sectional view taken along the line C-C of FIG. 6. In FIG. 6 and FIG. 7, there are illustrated two design panels 3 arranged in the up-and-down direction.

The design panel 3 is formed of a transparent member, for example, a transparent resin, and a design layer 3*f* is formed in the back surface of the design panel 3. In the design layer 3*f*, coloring, patterning, or painting is implemented by, for example, coating or printing. In this manner, the design layer 3*f* can be seen from the front surface side through the transparent resin. Further, as illustrated in FIG. 6, the entire front surface has a flat surface shape. Further, the design panel 3 has a rectangular shape. Under a state in which the indoor unit body 100 is mounted to the wall surface, in front view, a longitudinal direction of the design panel 3 corresponds to a lateral direction, that is, a horizontal direction, whereas a transverse direction of the design panel 3 corresponds to an up-and-down direction, that is, a vertical direction.

Further, as illustrated in FIG. 6 to FIG. 8, at positions that are close to end portions 3*a* in the transverse direction of the back surface of the design panel 3 and more inner side than the end portions 3*a*, first flanges 3*b* are formed to protrude toward the back surface side along the longitudinal direction. Further, at end portions 3*g* in the longitudinal direction, second flanges 3*e* are formed to protrude toward the back surface side along the transverse direction. Further, on outer surface sides of the first flanges 3*b*, a plurality of claw portions 3*c* each having a protruding shape are provided at intervals along the longitudinal direction. These claw portions 3*c* are formed at positions corresponding to the recesses 2*d* of the base panel 2. In this case, the claw portions 3*c* protrude toward the outer sides of the design panels 3.

Figure 11:
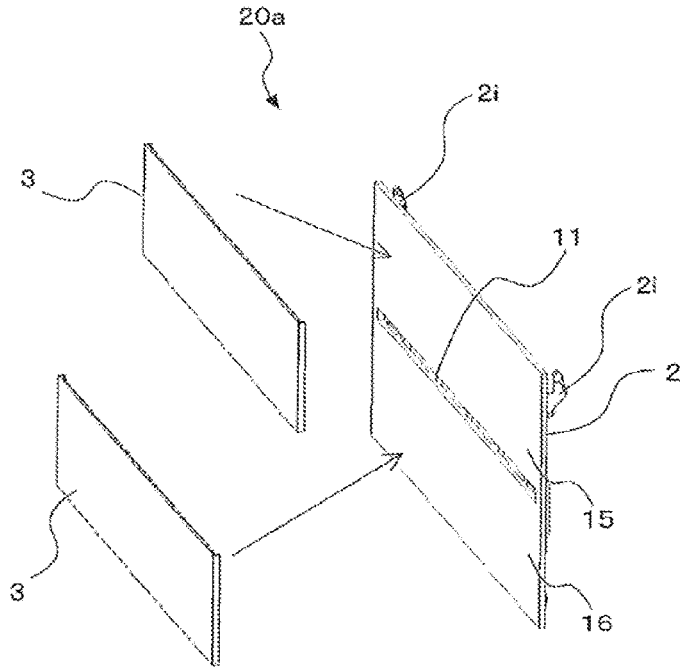
FIG. 11 is a perspective view for illustrating a front surface of a front panel of the indoor unit of the air-conditioning apparatus according to Embodiment of the present invention, in a state before the design panels are mounted to the base panel.
Figure 12:
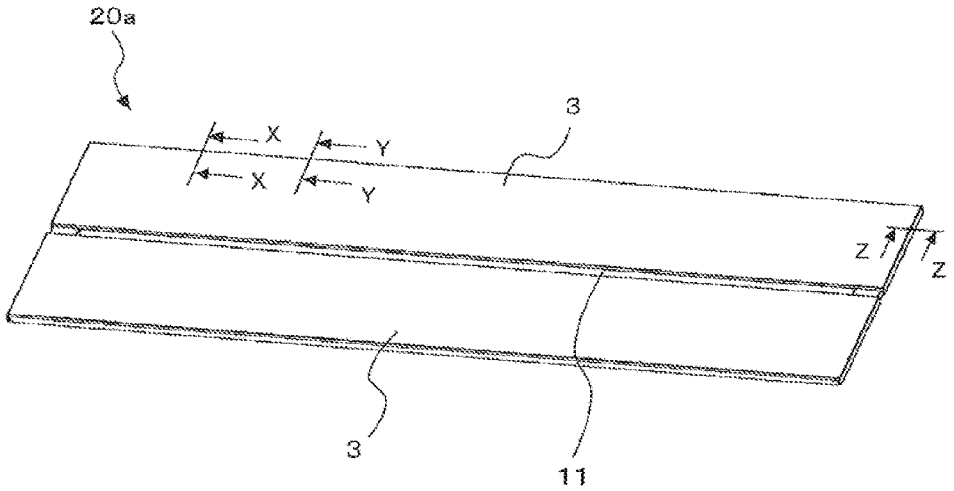
FIG. 12 is a perspective view for illustrating the front surface of the front panel of the indoor unit of the air-conditioning apparatus according to Embodiment 1 of the present invention.
Figure 13:
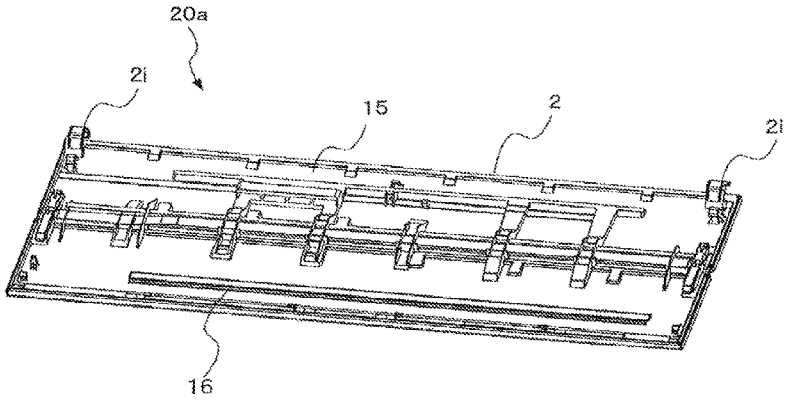
FIG. 13 is a perspective view for illustrating a back surface of the front panel of the indoor unit of the air-conditioning apparatus according to Embodiment 1 of the present invention.
Figure 14:
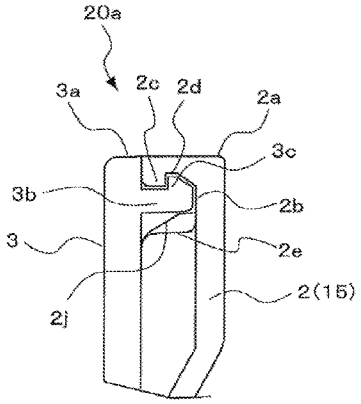
FIG. 14 is a sectional view taken along the line X-X of FIG. 12.
Figure 15:
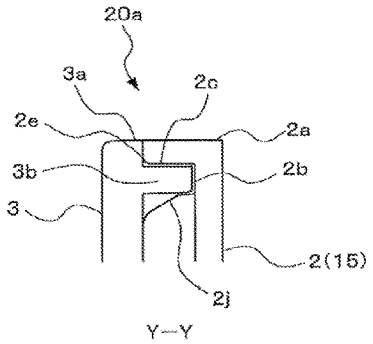
FIG. 15 is a sectional view taken along the line Y-Y of FIG. 12.
Figure 16:
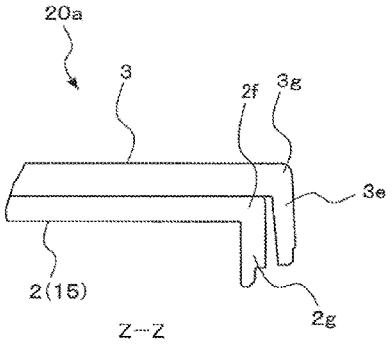
FIG. 16 is a sectional view taken along the line Z-Z of FIG. 12.

FIG. 11 is a perspective view for illustrating a front surface of the front panel 20*a* of the indoor unit of the air-conditioning apparatus according to Embodiment of the present invention, in a state before the design panels 3 are mounted to the base panel 2. FIG. 12 is a perspective view for illustrating the front surface of the front panel 20*a* of the indoor unit of the air-conditioning apparatus according to Embodiment 1 of the present invention. FIG. 13 is a perspective view for illustrating a back surface of the front panel 20*a* of the indoor unit of the air-conditioning apparatus according to Embodiment 1 of the present invention. FIG. 14 is a sectional view taken along the line X-X of FIG. 12. FIG. 15 is a sectional view taken along the line Y-Y of FIG. 12. FIG. 16 is a sectional view taken along the line Z-Z of FIG. 12. FIG. 12 and FIG. 16 are also used as illustrations of front panels 20*b*, 20*c*, and 20*d* of Embodiments 2 to 4 of the present invention described later. Further, a sectional view taken along the line X-X of FIG. 12, a sectional view taken along the line Y-Y of FIG. 12, and a sectional view taken along the line Z-Z of FIG. 12 are sectional views of an upper side of the front panel 20*a*, that is, sectional views in which the design panel 3 is mounted to the base panel upper portion 15. However, the same applies to sectional views of a lower side of the front panel 20*a*, that is, sectional views in which the design panel 3 is mounted to the base panel lower portion 16.

The rectangular front panel 20*a*, which is mounted to the front surface of the indoor unit body 100, includes the base panel 2 and the design panels 3. As illustrated in FIG. 11, the design panel 3 is mounted to each of the base panel upper portion 15 and the base panel lower portion 16 to cover the entire front surfaces of the base panel upper portion 15 and the base panel lower portion 16.

As illustrated in FIG. 15, at a side portion of the front panel 20*a* in the transverse direction, the first flange 3*b* of the design panel 3 is inserted into the groove portion 2*b* of the base panel 2. In this manner, the design panel 3 is mounted to the base panel 2 such that the first flange 3*b* of the design panel 3 is received in the groove portion 2*b* of the base panel 2. Further, as illustrated in FIG. 14, the claw portion 3*c* of the design panel 3 is inserted into the recess 2*d* of the base panel 2. In this manner, the design panel 3 is mounted to the base panel 2 such that the claw portion 3*c* of the design panel 3 is fitted to the recess 2*d* of the base panel 2. Further, as illustrated in FIG. 16, the design panel 3 is mounted to the base panel 2 such that the flange 2*g* of the base panel 2 is covered with the second flange 3*e* of the design panel 3 at a side portion of the front panel 20*a* in the longitudinal direction. Further, in the groove portion 2*b*, there are formed the plurality of ribs 2*j* along the longitudinal direction, and these ribs 2*j* are each brought into contact with the inner surface side of the first flange 3*b*.

In this case, the claw portion 3*c* of the design panel 3 is fitted to the recess 2*d* of the base panel 2, to thereby restrict movements in a forward-backward direction and a left-right direction. Also, the first flange 3*b* of the design panel 3 is brought into contact with the rib 2*j*, to thereby restrict movement in an up-down direction and coming off of the claw portion 3*c*. Further, when the indoor unit of the air-conditioning apparatus is operated, the first flange 3*b* is brought into contact with the rib 2*j* in this manner, thereby being capable of reducing a contact area of the design panel 3 to the base panel 2. As a result, a contact sound generated when the indoor unit of the air-conditioning apparatus is operated can be reduced.

Further, as illustrated in FIG. 14 and FIG. 15, at the side portion of the front panel 20*a* in the transverse direction, the end portion 3*a* of the design panel 3 is positioned at the same height as that of the first side wall portion 2*c* of each of the base panel upper portion 15 and the base panel lower portion 16. Further, as described above, at the side portion of the front panel 20*a* in the longitudinal direction, the flange 2*g* of the base panel 2 is covered with the second flange 3*e* of the design panel 3. Thus, in front view, the base panel upper portion 15 and the base panel lower portion 16 are hidden by the design panels 3. Further, in the transverse direction of the front panel 20*a*, the end portion 3*a* of the design panel 3 is positioned at the same height as that of the first side wall portion 2*c* of each of the base panel upper portion 15 and the base panel lower portion 16. Thus, when the indoor unit body 100 is viewed from the side surface of the front panel 20*a*, a boundary between the base panel 2 and the design panels 3 becomes less conspicuous, and hence the design property of the front panel 20*a* can be improved.

In Embodiment 1, the end portions 3*a* of the design panel 3 are positioned at the same height as those of the first side wall portions 2*c* of each of the base panel upper portion 15 and the base panel lower portion 16. However, their positional relationship is not limited to this configuration, and the end portion 3*a* of the design panel 3 only need to extend further outward than the first side wall portions 2*c* of each of the base panel upper portion 15 and the base panel lower portion 16. Also in this manner, in front view, the base panel upper portion 15 and the base panel lower portion 16 are hidden by the design panels 3.

The mounting structure of the design panel 3 to the base panel upper portion 15 and the mounting structure of the design panel 3 to the base panel lower portion 16 are described above, and are the same as each other.

As described above, in the indoor unit of the air-conditioning apparatus of Embodiment 1, in the front panel 20*a*, the first flanges 3*b* of the design panels 3 are received in the groove portions 2*b* of the base panel 2, and the recesses 2*d* of the base panel 2 and the claw portions 3*c* of the design panels 3 are fitted to each other. In this manner, the design panels 3 are mounted to the front surface side of the base panel 2 to cover the base panel 2. In this case, at each of the side portions of the front panel 20*a* in the transverse direction, the recess 2*d* is formed on the inner surface side of the first side wall portion 2*c* of the opaque base panel 2. Further, the claw portion 3*c* of the design panel 3 that is transparent but has the design layer 3*f* formed on its back surface side is positioned on the inner side of the first side wall portion 2*c* of the opaque base panel 2. Thus, the recess 2*d* of the base panel 2 and the claw portion 3*c* of the design panel 3 are not visually recognized from outside, and hence it is possible to improve the design property of the front panel 20*a*.

The front panel 20*a* of Embodiment 1 has the structure in which the design panel 3 is mounted to each of the base panel upper portion 15 and the base panel lower portion 16, but the structure is not limited to this configuration. For example, there may be employed a structure in which one design panel is mounted to a base panel constructed by only one of the base panel upper portion 15 and the base panel lower portion 16 and having no central recess 11 to cover the entire front surface of the base panel. Further, there may be employed a structure in which three or more design panels are mounted to the base panel to cover the entire front surface of the base panel. Also in such cases, the mounting structure of the front panel is the same as the structure described above.

The base panel upper portion 15 and the base panel lower portion 16 of Embodiment 1 correspond to the "base panel" of the present invention. The recess 2*d* corresponds to the "first fitting portion" of the present invention. The claw portion 3*c* corresponds to the "second fitting portion" of the present invention. The first flange 3*b* corresponds to the "flange" of the present invention.

Embodiment 2

Embodiment 2 of the present invention is described below, but (a part of) description of the matter overlapping with Embodiment 1 is omitted, and the same or corresponding components as those of Embodiment 1 are denoted by the same reference symbols.

Figure 17:
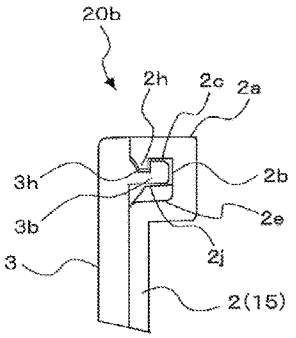
FIG. 17 is a sectional view taken along the line X-X of FIG. 12.

FIG. 17 is a sectional view taken along the line X-X of FIG. 12.

In a front panel 20*b* of Embodiment 2, instead of the claw portion 3*c* of the design panel 3 and the recess 2*d* of the base panel 2 of Embodiment 1 that are illustrated in FIG. 14, a claw portion 2*h* having a protruding shape is provided on an inner surface side of a first side wall portion 2*c* of a base panel 2, and a recess 3*h* having a recessed shape is formed on an outer surface side of the first flange 3*b* of the design panel 3. Further, the rib 2*j* having a protruding shape is provided on the outer surface side of a second side wall portion 2*e*. The claw portion 2*h* protrudes toward an inner side of the base panel 2, and the rib 2*j* protrudes toward an outer side of the base panel 2.

As illustrated in FIG. 17, at a side portion of the front panel 20*b* in the transverse direction, the first flange 3*b* of the design panel 3 is inserted into the groove portion 2*b* of the base panel 2. In this manner, the design panel 3 is mounted to the base panel 2 such that the first flange 3*b* of the design panel 3 is received in the groove portion 2*b* of the base panel 2. Further, the claw portion 2*h* of the base panel 2 is inserted into the recess 3*h* of the design panel 3. In this manner, the design panel 3 is mounted to the base panel 2 such that the claw portion 2*h* of the base panel 2 is fitted to the recess 3*h* of the design panel 3. Further, as illustrated in FIG. 16, at the side portion of the front panel 20*a* in the longitudinal direction, the design panel 3 is mounted to the base panel 2 such that the flange 2*g* of the base panel 2 is covered with the second flange 3*e* of the design panel 3. Further, in the groove portion 2*b*, there are formed the plurality of ribs 2*j* along the longitudinal direction, and these ribs 2*j* are each brought into contact with the inner surface side of the first flange 3*b* of the design panel 3.

In this case, the claw portion 2*h* of the base panel 2 is fitted to the recess 3*h* of the design panel 3, to thereby restrict movements in the forward-backward direction and the left-right direction. Also, the first flange 3*b* of the design panel 3 is brought into contact with the rib 2*j*, to thereby restrict movement in the up-down direction and coming off of the claw portion 2*h*. Further, when the indoor unit of the air-conditioning apparatus is operated, the first flange 3*b* is brought into contact with the rib 2*j* in this manner, thereby being capable of reducing the contact area of the design panel 3 to the base panel 2. As a result, the contact sound generated when the indoor unit of the air-conditioning apparatus is operated can be reduced.

As described above, in the indoor unit of the air-conditioning apparatus of Embodiment 2, in the front panel 20*b*, the first flanges 3*b* of the design panels 3 are received in the groove portions 2*b* of the base panel 2, and the claw portions 2*h* of the base panel 2 and the recesses 3*h* of the design panels 3 are fitted to each other. In this manner, the design panels 3 are mounted to the front surface side of the base panel 2 to cover the base panel 2. In this case, at each of the side portions of the front panel 20*a* in the transverse direction, the claw portion 2*h* is provided on the inner surface side of the first side wall portion 2*c* of the opaque base panel 2. Further, the recess 3*h* of the design panel 3 that is transparent but has the design layer 3*f* formed on its back surface side is positioned on the inner side of the first side wall portion 2*c* of the opaque base panel 2. Thus, the claw portion 2*h* of the base panel 2 and the recess 3*h* of the design panel 3 are not visually recognized from outside, and hence it is possible to improve the design property of the front panel 20*b*.

The claw portion 2*h* of Embodiment 2 corresponds to the "first fitting portion" of the present invention, and the recess 3*h* of Embodiment 2 corresponds to the "second fitting portion" of the present invention.

Embodiment 3

Embodiment 3 of the present invention is described below, but (a part of) description of the matter overlapping with Embodiment 1 and Embodiment 2 is omitted, and the same or corresponding components as those of Embodiment 1 and Embodiment 2 are denoted by the same reference symbols.

Figure 18:
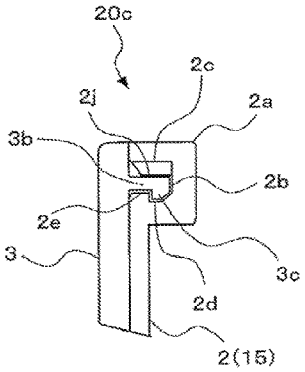
FIG. 18 is a sectional view taken along the line X-X of FIG. 12.

FIG. 18 is a sectional view taken along the line X-X of FIG. 12.

As illustrated in FIG. 14, in the front panel 20*a* of Embodiment 1, the claw portion 3*c* of the design panel 3 is provided on an outer surface side of the first flange 3*b*. However, as illustrated in FIG. 18, in a front panel 20*c* of Embodiment 3, the claw portion 3*c* of the design panel 3 is provided on the inner surface side of the first flange 3*b*. Further, as illustrated in FIG. 14, in the front panel 20*a* of Embodiment 1, the recess 2*d* of the base panel 2 is formed on the inner surface side of the first side wall portion 2*c*. However, as illustrated in FIG. 18, in the front panel 20*c* of Embodiment 3, the recess 2*d* of the base panel 2 is formed on the outer surface side of the second side wall portion 2*e* facing the first side wall portion 2*c*. Further, the rib 2*j* having a protruding shape is provided on the inner surface side of the first side wall portion 2*c*. The claw portion 3*c* protrudes toward the inner side of the design panel 3, and the rib 2*j* protrudes toward the inner side of the base panel 2.

As illustrated in FIG. 18, at a side portion of the front panel 20*c* in the transverse direction, the first flange 3*b* of the design panel 3 is inserted into the groove portion 2*b* of the base panel 2. In this manner, the design panel 3 is mounted to the base panel 2 such that the first flange 3*b* of the design panel 3 is received in the groove portion 2*b* of the base panel 2. Further, the claw portion 3*c* of the design panel 3 is inserted into the recess 2*d* of the base panel 2. In this manner, the design panel 3 is mounted to the base panel 2 such that the claw portion 3*c* of the design panel 3 is fitted to the recess 2*d* of the base panel 2. Further, as illustrated in FIG. 16, at the side portion of the front panel 20*a* in the longitudinal direction, the design panel 3 is mounted to the base panel 2 such that the flange 2*g* of the base panel 2 is covered with the second flange 3*e* of the design panel 3. Further, in the groove portion 2*b*, there are formed the plurality of ribs 2*j* along the longitudinal direction, and these ribs 2*j* are each brought into contact with the outer surface side of the first flange 3*b* of the design panel 3.

In this case, the claw portion 3*c* of the design panel 3 is fitted to the recess 2*d* of the base panel 2, to thereby restrict movements in the forward-backward direction and the left-right direction. Also, the first flange 3*b* of the design panel 3 is brought into contact with the rib 2*j*, to thereby restrict movement in the up-down direction and coming off of the claw portion 3*c*. Further, when the indoor unit of the air-conditioning apparatus is operated, the first flange 3*b* is brought into contact with the rib 2*j* in this manner, thereby being capable of reducing the contact area of the design panel 3 to the base panel 2. As a result, the contact sound generated when the indoor unit of the air-conditioning apparatus is operated can be reduced.

As described above, in the indoor unit of the air-conditioning apparatus of Embodiment 3, in the front panel 20*c*, the first flanges 3*b* of the design panels 3 are received in the groove portions 2*b* of the base panel 2, and the recesses 2*d* of the base panel 2 and the claw portions 3*c* of the design panels 3 are fitted to each other. In this manner, the design panels 3 are mounted to the front surface side of the base panel 2 to cover the base panel 2. In this case, at each of the side portions of the front panel 20*c* in the transverse direction, the recess 2*d* is formed in the second side wall portion 2*e* positioned on a more inner side than the first side wall portion 2*c* of the opaque base panel 2. Further, the claw portion 3*c* of the design panel 3 that is transparent but has the design layer 3*f* formed on its back surface side is positioned on the inner side of the first side wall portion 2*c* of the opaque base panel 2. Thus, the recess 2*d* of the base panel 2 and the claw portion 3*c* of the design panel 3 are not visually recognized from outside, and hence it is possible to improve the design property of the front panel 20*c*.

The recess 2*d* of Embodiment 3 corresponds to the "first fitting portion" of the present invention, and the claw portion 3*c* of Embodiment 3 corresponds to the "second fitting portion" of the present invention.

Embodiment 4

Embodiment 4 of the present invention is described below, but (a part of) description of the matter overlapping with Embodiments 1 to 3 is omitted, and the same or corresponding components as those of Embodiments 1 to 3 are denoted by the same reference symbols.

Figure 19:
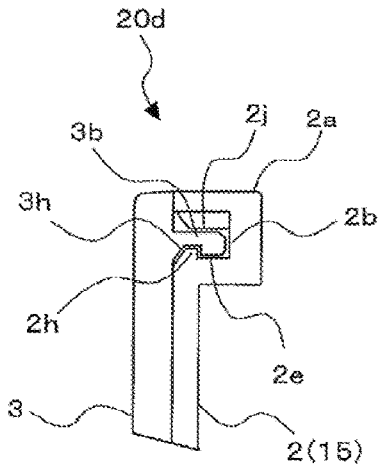
FIG. 19 is a sectional view taken along the line X-X of FIG. 12.

FIG. 19 is a sectional view taken along the line X-X of FIG. 12.

As illustrated in FIG. 17, in the front panel 20*b* of Embodiment 2, the claw portion 2*h* of the base panel 2 is provided on the inner surface side of the first side wall portion 2*c*. However, as illustrated in FIG. 19, in a front panel 20*d* of Embodiment 4, the claw portion 2*h* of the base panel 2 is provided on the outer surface side of the second side wall portion 2*e*. Further, as illustrated in FIG. 17, in the front panel 20*b* of Embodiment 2, the recess 3*h* of the design panel 3 is formed on the outer surface side of the first flange 3*b*. However, as illustrated in FIG. 19, in the front panel 20*d* of Embodiment 4, the recess 3*h* of the design panel 3 is formed on the inner surface side of the first flange 3*b*. Further, the rib 2*j* having a protruding shape is provided on the inner surface side of the first side wall portion 2*c*. The claw portion 2*h* protrudes toward the outer side of the base panel 2, and the rib 2*j* protrudes toward the inner side of the base panel 2.

As illustrated in FIG. 19, at a side portion of the front panel 20*c* in the transverse direction, the first flange 3*b* of the design panel 3 is inserted into the groove portion 2*b* of the base panel 2. In this manner, the design panel 3 is mounted to the base panel 2 such that the first flange 3*b* of the design panel 3 is received in the groove portion 2*b* of the base panel 2. Further, the claw portion 2*h* of the base panel 2 is inserted into the recess 3*h* of the design panel 3. In this manner, the design panel 3 is mounted to the base panel 2 such that the claw portion 2*h* of the base panel 2 is fitted to the recess 3*h* of the design panel 3. Further, as illustrated in FIG. 16, at the side portion of the front panel 20*a* in the longitudinal direction, the design panel 3 is mounted to the base panel 2 such that the flange 2*g* of the base panel 2 is covered with the second flange 3*e* of the design panel 3. Further, in the groove portion 2*b*, there are formed the plurality of ribs 2*j* along the longitudinal direction, and these ribs 2*j* are each brought into contact with the outer surface side of the first flange 3*b* of the design panel 3.

In this case, the claw portion 2*h* of the base panel 2 is fitted to the recess 3*h* of the design panel 3, to thereby restrict movements in the forward-backward direction and the left-right direction. Also, the first flange 3*b* of the design panel 3 is brought into contact with the rib 2*j*, to thereby restrict movement in the up-down direction and coming off of the claw portion 2*h*. Further, when the indoor unit of the air-conditioning apparatus is operated, the first flange 3*b* is brought into contact with the rib 2*j* in this manner, thereby being capable of reducing the contact area of the design panel 3 to the base panel 2. As a result, the contact sound generated when the indoor unit of the air-conditioning apparatus is operated can be reduced.

As described above, in the indoor unit of the air-conditioning apparatus of Embodiment 4, in the front panel 20*d*, the first flanges 3*b* of the design panels 3 are received in the groove portions 2*b* of the base panel 2, and the claw portions 2*h* of the base panel 2 and the recesses 3*h* of the design panels 3 are fitted to each other. In this manner, the design panels 3 are mounted to the front surface side of the base panel 2 to cover the base panel 2. In this case, at each of the side portions of the front panel 20*d* in the transverse direction, the claw portion 2*h* is provided on the second side wall portion 2*e* positioned on the more inner side than the first side wall portion 2*c* of the opaque base panel 2. Further, the recess 3*h* of the design panel 3 that is transparent but has the design layer 3*f* formed on its back surface side is positioned on the inner side of the first side wall portion 2*c* of the opaque base panel 2. Thus, the claw portion 2*h* of the base panel 2 and the recess 3*h* of the design panel 3 are not visually recognized from outside, and hence it is possible to improve the design property of the front panel 20*d*.

The claw portion 2*h* of Embodiment 4 corresponds to the "first fitting portion" of the present invention, and the recess 3*h* of Embodiment 4 corresponds to the "second fitting portion" of the present invention.

REFERENCE SIGNS LIST

1 back case 2 base panel 2*a* end portion 2*a*1 upper end portion 2*a*2 lower end portion 2*b* groove portion 2*c* first side wall portion 2*d* recess 2*e* second side wall portion 2*f* end portion 2*f*1 left end portion 2*f*2 right end portion 2*g* flange 2*h* claw portion 2*i* hinge 2*j* rib 3 design panel 3*a* end portion 3*b* first flange 3*c* claw portion 3*e* second flange 3*f* design layer 3*g* end portion 3*h* recess 4 upper air inlet 5 air outlet 6 air-sending fan 7 heat exchanger 8 drain pan 9 filter

10 up-and-down airflow direction adjusting flap 11 central recess 12 front air inlet 15 base panel upper portion 16 base panel lower portion 17 connection portion 20*a* front panel 20*b* front panel 20*c* front panel 20*d* front panel 100 indoor unit body

The invention claimed is:

1. An indoor unit of an air-conditioning apparatus, comprising a front panel provided on a front surface side of an indoor unit body, the front panel including a base panel formed of an opaque member, and a design panel formed of a transparent member, and having a design layer on a back surface of the design panel, the base panel having a front surface including a first side wall portion formed at an end portion of the base panel in a vertical direction, and extending along a horizontal direction, a second side wall portion formed on a more inner side than the first side wall portion, and extending along the horizontal direction, a groove portion formed between the first side wall portion and the second side wall portion, and having a recessed shape continuous along the horizontal direction, and a plurality of first fitting portions provided at intervals on an inner surface side of the first side wall portion, and aligned along the horizontal direction, the design panel having the back surface including a flange formed on a more inner side than an end portion of the design panel in the vertical direction, and protruding along the horizontal direction, and a plurality of second fitting portions provided at intervals on an outer surface side of the flange, and aligned along the horizontal direction, each of the plurality of first fitting portions comprising a claw portion having a protruding shape, and each of the plurality of second fitting portions comprising a recess having a recessed shape, or each of the plurality of first fitting portions comprising a recess having a recessed shape, and each of the plurality of second fitting portions comprising a claw portion having a protruding shape, the front panel being formed of the design panel mounted to a front surface side of the base panel, the flange of the design panel being received in the groove portion of the base panel, the plurality of first fitting portions of the base panel and the plurality of second fitting portions of the design panel being fitted to each other.

2. The indoor unit of an air-conditioning apparatus of claim 1, wherein the second side wall portion has an outer surface side including a plurality of ribs formed at intervals, and aligned along the horizontal direction, and each having a protruding shape, and wherein the plurality of ribs are brought into contact with an inner surface side of the flange of the design panel.

3. An indoor unit of an air-conditioning apparatus, comprising a rectangular front panel provided on a front surface side of an indoor unit body, the rectangular front panel including a base panel formed of an opaque member, and a design panel formed of a transparent member, and having a design layer on a back surface of the design panel, the base panel having a front surface including a first side wall portion formed at an end portion of the base panel in a vertical direction, and extending along a horizontal direction, a second side wall portion formed on a more inner side than the first side wall portion, and extending along the horizontal direction, a groove portion formed between the first side wall portion and the second side wall portion, and having a recessed shape continuous along the horizontal direction, and a plurality of first fitting portions provided at intervals on an outer surface side of the second side wall portion, and aligned along the horizontal direction, the design panel having the back surface including a flange formed on a more inner side than an end portion of the design panel in the vertical direction, and protruding along the horizontal direction, and a plurality of second fitting portions provided at intervals on an inner surface side of the flange, and aligned along the horizontal direction, each of the plurality of first fitting portions comprising a claw portion having a protruding shape, and each of the plurality of second fitting portions comprising a recess having a recessed shape, or each of the plurality of first fitting portions comprising a recess having a recessed shape, and each of the plurality of second fitting portions comprising a claw portion having a protruding shape, the rectangular front panel being formed of the design panel mounted to a front surface side of the base panel, the flange of the design panel being received in the groove portion of the base panel, the plurality of first fitting portions of the base panel and the plurality of second fitting portions of the design panel being fitted to each other.

4. The indoor unit of an air-conditioning apparatus of claim 3, wherein the first side wall portion has an inner surface side including a plurality of ribs formed at intervals, and aligned along the horizontal direction, and each having a protruding shape, and wherein the plurality of ribs are brought into contact with an outer surface side of the flange of the design panel.

5. The indoor unit of an air-conditioning apparatus of claim 1, wherein formed positions of the plurality of first fitting portions are shifted from formed positions of the plurality of second fitting portions in the horizontal direction.

* * * * *